United States Patent [19]

Walz

[11] 4,117,372

[45] Sep. 26, 1978

[54] GAS DISCHARGE LAMP WITH DOUBLE-ELECTRODE POWERED THROUGH A RECTIFIER, AND DISCHARGE-TIGHT CROSS-CONNECTION OF THE ELECTRODE CHAMBERS, AND A PROCESS FOR ITS MANUFACTURE

[76] Inventor: Alfred Walz, Am Kurzarm 7, Emmendingen, Germany, 7830

[21] Appl. No.: 738,965

[22] Filed: Nov. 4, 1976

[30] Foreign Application Priority Data

Nov. 4, 1975 [DE] Fed. Rep. of Germany ..... 254919
Oct. 9, 1976 [DE] Fed. Rep. of Germany ..... 2645794

[51] Int. Cl.[2] ..... H01J 7/44; H01J 13/46; H01J 29/19; H01K 1/62

[52] U.S. Cl. ..... 315/71; 313/204; 313/205; 315/73

[58] Field of Search ..... 315/73, 71; 313/204, 313/205, 190, 493

[56] References Cited

U.S. PATENT DOCUMENTS

| | | | |
|---|---|---|---|
| 3,117,248 | 1/1964 | Lake | 313/204 X |
| 3,240,861 | 3/1966 | Christy | 313/204 X |
| 3,549,941 | 6/1968 | Friedmann | 315/60 |
| 3,609,436 | 9/1971 | Campbell | 313/204 |
| 3,646,383 | 2/1972 | Jones et al. | 313/493 |

*Primary Examiner*—Saxfield Chatmon, Jr.
*Attorney, Agent, or Firm*—Browdy and Neimark

[57] ABSTRACT

Gas discharge lamps, especially of the fluorescent tube type, powered from the A.C. line through a rectifier, with a double electrode arrangement and a discharge-type cross connection of the electrode chambers, characterized by the fact that preferably straight glass tube sections of equal length are connected to form an elongated rectangular unit by means of two geometrically equal U-shaped end pieces by the fact that a gas-discharge-tight diaphragm, which is permeable to mercury vapor is provided on one U-shaped end, as well as electrode holders being provided on both sides thereof and at least one pump nipple tube being provided in the other U-shaped end piece.

18 Claims, 7 Drawing Figures

Fig.2
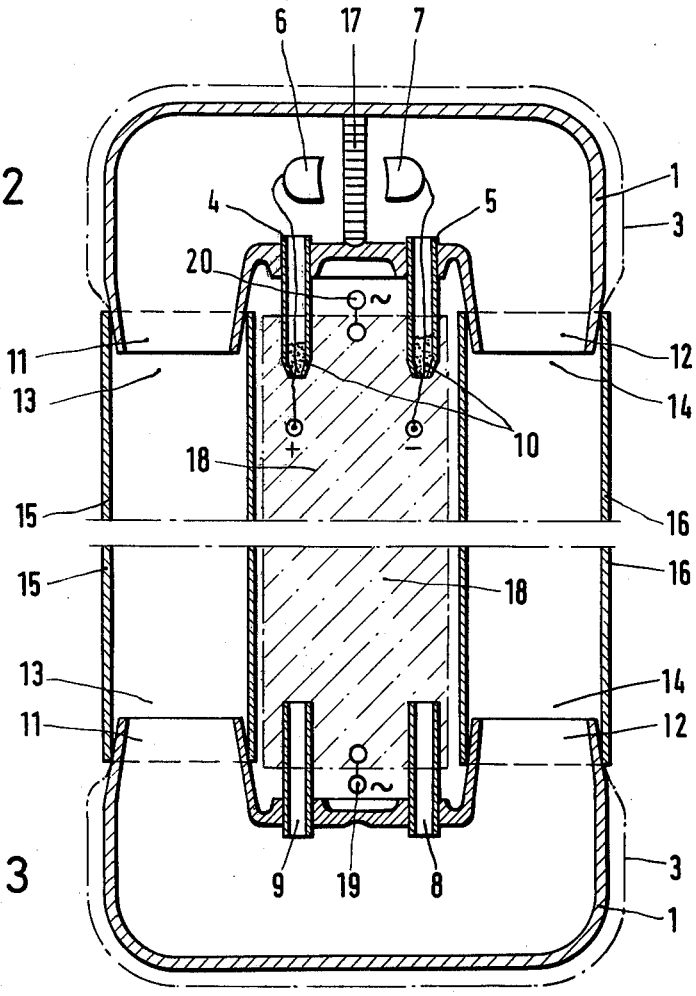
Fig.3
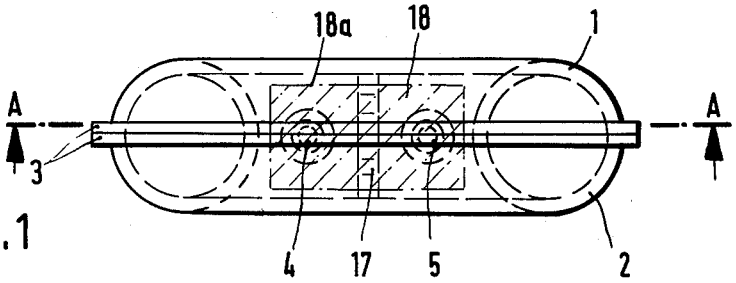
Fig.1

GAS DISCHARGE LAMP WITH DOUBLE-ELECTRODE POWERED THROUGH A RECTIFIER, AND DISCHARGE-TIGHT CROSS-CONNECTION OF THE ELECTRODE CHAMBERS, AND A PROCESS FOR ITS MANUFACTURE

The invention relates to a gas discharge lamp powered from an A.C. line through a rectifier, and more particularly, a fluorescent bulb, with a double-electrode arragement and a discharge-tight cross-connection of the electrode chambers.

BACKGROUND OF THE INVENTION

A double electrode arrangement with a gas discharge-tight cross-connection of the electrode chambers in already known for gas discharge tubes operated on D.C., in which the cross-connection is in the form of an annular gap between a cylindrical tube and a cylinder inserted into the tube and closed at at least one end. This ensures that the two electrode chambers are connected by a channel of sufficiently small cross section so that no electrical gas discharge can occur in this channel, but a flow of metal vapor or gas molecules can occur through this channel as a result of a pressure differential and/or diffusion.

In this manner, the improverishment of the anode area, for example with respect to mercury ions, so-called cataphoresis which is disadvantageous for the production of light, can be prevented in D.C. operation (German Offenlegungesschrift 2,254,709).

To produce a cataphoresis-free operating, D.C. operated gas discharge lamp, it is also known to form the cross-connection between the electrode chambers, which are at the electrical ignition and operating D.C. voltage, by a capillary which passes through a partition preferably made of glass, with the electrodes being brought close on both sides to within a short distance in order to avoid discharge-free zones in the vicinity of the capillary (German Offenlegungsschrift 2,319,401).

For D.C. operation of gas discharge lamps from an A.C. source, a circuit is known in which a power supply circuit in the form of a voltage multiplier circuit composed of rectifier diodes and capacitors and low-power ignition circuit supplying a high voltage are combined to form a voltage multiplier circuit consisting of a plurality of voltage-doubling stages connected in series (German Patent 1,639,108).

Finally, a device is known for powering gas discharge lamps from an A.C. line with a rectifier in the form of a voltage multiplier circuit with a ballast traversed by the lamp current, wherein the iron core of the ballast is provided with an internal cavity in which the components of the rectifier assembly are installed (German Patent 2,133,669).

SUMMARY OF THE INVENTION

An object of the present invention is to provide for improved gas discharge lamps. Another object is to produce a gas discharge lamp using the above-described known devices and construction principals, such lamp producing increased luminosity relative to known fluorescent tubes and easily manufactured on a mass-production basis.

These objectives are achieved according an embodiment of to the invention in a gas discharge lamp of the type described above primarily by virtue of the fact that preferably straight glass tubes of equal length are connected by means of two geometrically identical U-shaped end pieces to form an elongated rectangular unit, by the fact that at one U-shaped end a gas discharge type diaphragm, allowing mercury vapor to pass through, is provided, as well as electrode holders in both sides thereof, and at least one pump nipple provided in the other U-shaped end piece.

By means of the design according to the invention, a nearly doubled discharge path is obtained with essentially the same overall length. This also ensures a much better ratio between the cathode drop and the operating voltage. In addition, the tube cross section can be made smaller, whereby a higher operating voltage of approximately 300 V can be optimally employed.

It is especially advantageous if the U-shaped end pieces are each made of two congruent halves and are provided with recesses for the electrode holders and the pump nipples. Advantageously, the U-shaped end pieces can consist of envelope halves made of pressed glass. However, according to a modified embodiment of the invention, they can also be made in molds from fritted glass fibers.

Gas discharge lamps of this type can be produced in moderate numbers at low machine expense, whereby according to a further feature of the invention the gas type connection of all parts can be provided by means of sealing glass.

According to a further embodiment of the invention, which is intended primarily for the production of a large number of units using glass tube bending and sealing automatic machinery, the rectangle is made from one long straight tube by bending in such manner that a U-shaped end piece is formed, integral with the long sides, and by the fact that a prefabricated assembly with electrodes and a partition which is gas discharge-tight but permits mercury vapor to pass through, is arranged in a chamber in a second short side, and is connected with the free leg of the bent tube.

Preferably, a diaphragm made of fritted glass fibers serves as the partition.

It is particularly advantageous if the electrode holders are connected with instant-start oxide electrodes.

Advantageously, at least one pump nipple is provided in the assembly between the free legs.

In a preferred embodiment of the invention, a ballast, for example according to German Patent No. 1,639,108, is provided inside the rectangle for ignition and operation, designed for connection to an A.C. line in such manner that the electrode terminals provided for connection to the high D.C. voltage from the ballast are electrically insulated and the ends of the pump nipples are covered in a mechanically protective manner, and only two low-voltage terminals for connection to an A.C. line at ordinary voltage are brought out.

A pair of contact pins of the type conventionally used for connecting fluorescent bulbs to the line can be provided on the short sides of the rectangle.

According to a modification of the invention, it is also possible to use an Edison socket as the line connection.

The invention also includes a method for manufacturing of such gas discharge tubes designed to be powered through rectifiers from the A.C. line, with a double electrode arrangement and discharge-tight cross-connection of the electrode chambers.

According to an embodiment of fabrication according to the invention, two tubes, straight and of equal length, and two short U-shaped connecting pieces are assembled to form a rectangle, said U-shaped pieces each consisting of two envelope halves. Before assembly of these envelope halves, a mercury-vapor permeable dischargetight diaphragm, the two electrodes, and the pump nipples, are installed following application of sealing glass in the form of a paste to all points and surfaces to be sealed relative to the outside. Next, the entire assembly is brought to the melting point of the sealing glass applied previously, and then finally cooled to room temperature. After cooling the elongated O-shaped tube is a complete mechanical unit.

In an especially advantageous manner, the U-shaped envelope halves are made of pressed glass.

According to a modification of the method of manufactuure, the envelope halves for the U-shaped end pieces are pressed and fritted from glass fibers in hot molds. The porosity of the glass fibers fritted in the hot molds can be sealed by the sealing glass simultaneously with the connection of all parts using the same sealing glass. Such fritted glass fiber bodies exhibit good elasticity, thus considerably facilitating the assembly of all parts.

According to a modification of the process of the invention, as elongated U-shape is first bent from a straight tube, and then the straight, free and open tube ends are each bent through a quarter circle, and a prefabricated partition is fitted into the space formed by the gap between the quarter circles, and then the tube ends are joined by glass-melting techniques.

It is particularly advantageous if the straight tube is coated with phosphor before bending.

BRIEF DESCRIPTION OF THE DRAWINGS

Further features and advantages of the invention will be discussed in greater detail with reference to the drawings which are schematic examples.

FIG. 1 is a side elevation of a gas-discharge lamp according to the invention;

FIG. 2 is a top view along line A—A in FIG. 1;

FIG. 3 shows a second U-bend of the device of FIGS. 1 and 2;

DETAILED DESCRIPTION OF ILLUSTRATED EMBODIMENTS

Figure 4:
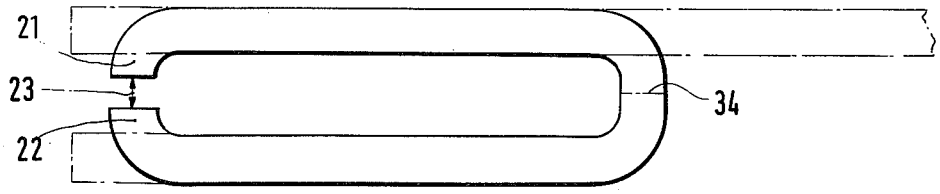
FIG. 4 shows an intermediate stage of manufacture of a second sample embodiment.

FIG. 1 shows a first embodiment of a gas discharge lamp according to the invention in a completely assembled condition.

U-shaped end pieces, formed of halves or envelope halves 1, 2 are disposed between two, for example straight, fluorescent tube sections 15, 16. Each of the two halves 1, 2 is provided with one flat edge portion 3. These symmetrical glass parts 1, 2 will be referred to hereinbelow as pressed glass parts, but they can also be made in an advantageous manner from glass fibers pressed and fritted together in hot molds. In final assembly, halves 1, 2 are sealed together with the remaining parts using sealing glass.

FIG. 2 shows two electrodes 6 and 7, which are mounted on either side of a diaphragm 17, such diaphragm being permeable to metal vapor e.g. mercury vapor. A pair of glass tubes 4 and 5 serve as holders for the electrodes 6 and 7 with pinch-type lead-in 10. In FIG. 3, a pair of tubes 8 and 9 are shown, which serve as pump nipples in the process of cleaning the discharge chamber and purging it with a working gas, e.g., argon.

It is apparent from FIGS. 2 and 3, that the superimposed pressed glass halves 1, 2 have slightly conical ends 11, 12 which penetrate into openings 13, 14 of the two straight fluorescent tube sections 15, 16 to suitable distances for effecting an adequate seal and are then sealed to these tubular sections to form a mechanical unit in the shape of an elongated rectangle.

The diaphragm 17 serves to prevent a discharge through the short gap between the electrodes 6 and 7. However, by virtue of its appropriately selected permeability, for hot metal vapor, especially mercury vapor, the diaphragm 17 allows transmission of the vapor from the cathode chamber to the anode chamber under the influence of the pressure differential which is developed during gas discharge operation with direct current between the two sides of diaphragm 17. This prevents the undesirable phenomenon of cataphoresis during energy-saving D.C. operation.

In the interior chamber shown in FIGS. 1 to 3 with a dot-dash shaded area, between the glass parts which conduct the gas discharge, a ballast 18 in a preferably elongated form is provided, such ballast being powered from an A.C. line; the ballast also provides a high ignition voltage and then the required operating voltage. The ballast 18 is provided with an electrically insulating covering **18*a* which also encloses the electrode terminals 4, 5 with pinch-type lead-in 10, as well as the ends of pump nipples 8, 9 in an electrically insulating manner, protecting them against mechanical damage. Connection to the A.C. line is via a pair of terminals 19 and 20. The covering 18*a*, shown as rectangular in FIGS. 1 to 3**, may comprise a plastic with good insulating properties.

Figure 5:
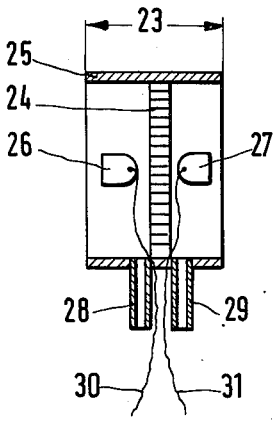
FIG. 5 shows an assembly which can be used in conjunction with the bent tube according to FIG. 4.
Figure 6:
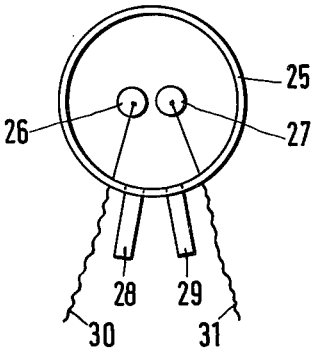
FIG. 6 is an end view of the part according to FIG. 5.

In a second embodiment as shown in FIGS. 4 to 7, an elongated U-shape according to FIG. 4 with the desired dimensions such as tube length and spacing, is bent from a straight tube, which is shaped on a mass-production basis in known automatic machinery and is preferably subjected to processing when already coated with a suitable phosphor material conventionally used for fluorescent lamps. In conjunction with the same or a subsequent bending process, the initially still straight free and open tube ends 21, 22 are each bent through a quarter circle in such manner that ends 21 and 22 end up opposite one another with a preset distance 23 between them. In the space left by gap 23, an anti-cataphoresis assembly 25 shown in FIGs. 5 and 6 is fitted in a subsequent work step and then connected to tube ends 21 and 22 by glass-melting techniques, preferably using a special automatic machine.

The assembly 25 is shown in FIGS. 5 and 6 in partial cross section and in an end view. In a glass tube 25, which has approximately the same diameter and wall thickness as parts 21 and 22 but an axial length which corresponds approximately to the distance 23 between the bent tube ends 21 and 22, a gas-discharge tight diaphragm 24, but permeable to metal vapor, and consisting for example of fritted glass fibers, is disposed. On both sides of the diaphragm 24 are provided two electrodes 26 and 27, preferably instant-starting oxide electrodes, which are spontaneously heated by the operating current. In addition, two pump nipples 28 and 29, each located at one tube end 21 or 22, are provided in the glass tube 25. Finally, a pair of gas-tight power leads 30 and 31 are fused in electrodes 26 and 27 in the glass tube 25.

Figure 7:
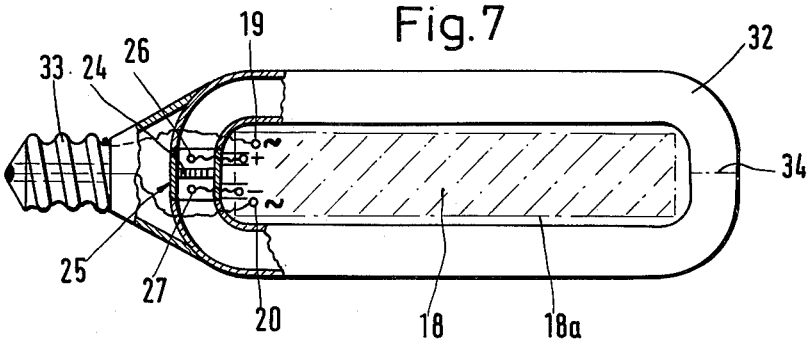
FIG. 7 shows a finished gas discharge lamp according to the second sample embodiment, with an Edision socket.

FIG. 7 shows a finished gas discharge lamp according to the second embodiment in the form of a gas discharge tube 32 which is mechanically formed to a O-shape, with the glass tube 25 sealed in place, whereby a rectifier-ballast unit 18 is disposed in the O-space between the straight tube ends, the rectifier-ballast unit being connected to the line in the example shown by means of a conventional Edison socket 33. The rectifier ballast unit 18 in this arrangement is preferably made in the form of a rod with a circular cross section with a light-reflecting surface.

In FIG. 7, an insulating covering 18*a* for the unit 18 is made in a circular shape and in such manner that the electrode connections for contact-voltage protection are covered in an appropriately electrically insulated manner and pump nipples 28, 29 are protected against mechanical damage.

The fluorescent bulb unit according to the invention, and in accordance with the embodiments shown, can also be used as a substitute for normal tube-type fluorescent bulbs operated directly from A.C., with pin contacts on both ends in existing light fixtures, if conventional fuorescent bulb pin contacts are provided on the narrow side of the rectangular or O-shaped bulb structure, and connected to contacts 19, 20 electrically. The conventional glow-starter can be eliminated in this case, as well as the conventional ballast.

Anti-cataphoresis component 25, with electrode mounting according to FIGS. 5 and 6, by virtue of its relatively small dimensions can also be provided in any discharge configuration, e.g., helically coiled, as a connecting element between the beginning and end of such configurations. The design of the ballast is then modified to suit the particular configuration.

In the embodiment according to FIGS. 4 to 7, the elongated O-shape which is shown can also be made from two straight tubes with ends bent at right angles on both sides. Then a sealed connection is provided at point 34 in FIGS. 4 to 7. This can be accomplished automatically at the same time as the sealing of glass tube section 25 is space 23.

The invention is not limited to the embodiment shown and described, but includes modifications and adaptions made by experts and routineers, as well as improvements, and all partial constructions and subcombinations of the features and measures described and/or shown.

I claim:

1. In a gas discharge lamp, especially of the fluorescent tube type, powered from an A.C. line through a rectifier, with a double electrode arrangement and a discharge-type cross connection of the electrode chambers, the body of said lamp comprising a pair of substantially straight glass tube sections of equal lengths, said lamp further comprising a gas-discharge-tight passage, the improvement wherein said glass tube sections are prefabricated and are connected by two prefabricated geometrically equal generally U-shaped end pieces, one of said end pieces having extending thereacross a diaphragm, permeable to metal vapor and constituting said gas-discharge-tight passage, a first electrode holder provided on one side of said diaphragm and a second electrode holder on the other side of said diaphragm, and at least one pump nipple tube being provided in a said end piece.

2. A fluorescent bulb according to claim 1, wherein the U-shaped end pieces are each composed of two congruent halves and are provided with recesses for the electrode holders and the pump nipples.

3. A fluorescent bulb according to claim 2, wherein the U-shaped end pieces consist of envelope halves made of pressed glass.

4. A fluorescent bulb according to claim 2, wherein the U-shaped end pieces are made of fritted glass fibers.

5. A fluorescent bulb according to claim 1, wherein said straight glass tube sections and U-shaped end pieces are connected by sealing glass.

6. A fluorscent bulb according to claim 1, wherein said diaphragm is made of fritted glass fibers.

7. Process for the manufacture of a gas discharge lamp according to claim 1 wherein said metal vapor permeable diaphragm is preassembled together with the two electrodes and the pump nipple: two straight tubes of equal length and two short U-shaped connecting pieces are assembled to form a rectangle, the U-shaped pieces being each composed of two envelope halves; sealing glass is applied as a paste to all points and surfaces to be sealed relative to the outside; and the entire assembly is brought to the melting point of the sealing glass which has been applied and then cooled again to room temperature.

8. Method for manufacturing a gas discharge lamp according to claim 7, wherein the U-shaped envelope halves are made of pressed glass.

9. Method according to claim 7, wherein the envelope halves for the U-shaped end pieces are pressed and fritted from glass fibers in hot molds.

10. In a gas discharge lamp, especially of the fluorescent tube type, powered from an A.C. line through a rectifier, with a double electrode arrangement and a discharge-type cross connection of the electrode chambers, the body of said lamp comprising a pair of substantially straight glass tube sections of equal lengths, said lamp further comprising a gas-discharge-tight passage, the improvement wherein said glass tube sections are prefabricated and together form a U-shaped interconnection at one end and are connected at the other end by a prefabricated end piece to define a generally rectangular configuration having an open central area, said prefabricated end piece having extending thereacross a diaphragm permeable to metal vapor and constituting said gas-discharge-tight passage, a first electrode holder provided on one side of said diaphragm and a second electrode holder on the other side of said diaphragm, and at least one pump nipple tube provided in said end piece.

11. A fluorescent bulb according to claim 10, wherein the straight glass tube sections of equal lengths joined at one end are made from one long straight tube by bending in such manner that the end opposite said prefabricated end is formed integral with the lengthwise sides, the two free ends of said long tube also being bent so as to face one another, said prefabricated end piece fitting in the space between the ends of the bent tube and being sealed thereto.

12. Fluorescent bulb according to claim 11, wherein said diaphragm is made of fritted glass fibers.

13. Fluorescent bulb according to claim 11, wherein said electrodes are instant-starting oxide electrodes.

14. Fluorescent bulb according to claim 11, wherein said at least one pump nipple is provided in said prefabricated end piece.

15. Fluorescent bulb according to claim 10, wherein a ballast is provided in the interior of the rectangle, said ballast comprising means for ignition and operation of said lamp when connected to an A.C. line, said ballast having insulation provided in such manner that the electrode terminals which are powered with high D.C. voltage from the ballast are electrically insulated and the pump nipple end is covered in a mechanically protected fashion, and only two low-voltage terminals for connection to the usual voltage from an A.C. line are brought out of the insulation.

16. Fluorescent bulb according to claim 11 further comprising an Edison socket provided as a line connection.

17. Process for manufacturing gas discharge lamp according to claim 10, wherein an elongated U-shape is initially bent from a straight glass tube, the free and open ends are each bent through a quarter circle so that said ends face one another providing a space therebetween, a prefabricated tube is fitted into the space between the quarter circle bends, and said tube is then connected to the ends of said tube by glass melting.

18. Method according to claim 17, wherein the straight tube is coated with phosphor material before bending.

* * * * *

UNITED STATES PATENT AND TRADEMARK OFFICE

CERTIFICATE OF CORRECTION

PATENT NO. : 4,117,372

DATED : September 26, 1978

INVENTOR(S) : Alfred WALZ

It is certified that error appears in the above-identified patent and that said Letters Patent are hereby corrected as shown below:

Title page, [30] Foreign Application Priority Data, the number of the first priority document should read --2549419--

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*